US008391763B2

(12) United States Patent
Chiba

(10) Patent No.: US 8,391,763 B2
(45) Date of Patent: Mar. 5, 2013

(54) BELT DRIVING APPARATUS, AND IMAGE FORMING APPARATUS HAVING BELT DRIVING APPARATUS

(75) Inventor: Takatoshi Chiba, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 288 days.

(21) Appl. No.: 12/844,019

(22) Filed: Jul. 27, 2010

(65) Prior Publication Data

US 2011/0026989 A1 Feb. 3, 2011

(30) Foreign Application Priority Data

Jul. 28, 2009 (JP) ..... 2009-175202

(51) Int. Cl.
*G03G 15/20* (2006.01)

(52) U.S. Cl. ..... 399/329

(58) Field of Classification Search ..... 399/67, 399/68, 122, 162–165, 320, 328, 329; 219/216, 219/619

See application file for complete search history.

(56) References Cited

U.S. PATENT DOCUMENTS

| | | | | |
|---|---|---|---|---|
| 5,153,655 | A * | 10/1992 | Suzuki et al. | 399/329 |
| 5,394,222 | A * | 2/1995 | Genovese | 399/167 |
| 6,246,858 | B1 * | 6/2001 | Condello et al. | 399/329 |
| 7,457,576 | B2 | 11/2008 | Takada et al. | |
| 8,112,021 | B2 * | 2/2012 | Mochizuki | 399/302 |
| 2007/0059065 | A1 | 3/2007 | Takada et al. | |

FOREIGN PATENT DOCUMENTS

| | | | |
|---|---|---|---|
| JP | 4-104180 | A | 4/1992 |
| JP | 2007-79034 | A | 3/2007 |

* cited by examiner

*Primary Examiner* — Hoan Tran
(74) *Attorney, Agent, or Firm* — Fitzpatrick, Cella, Harper & Scinto

(57) ABSTRACT

A belt driving apparatus includes a first rotatable belt member; a first supporting member rotatably supporting the first belt member; a first steering roller, rotatably supporting the first belt member; a first controller for controlling movement of an end of the first steering roller; a second rotatable belt member contacted to the first belt member; a second supporting member rotatably supporting the second belt member; a second steering roller, rotatably supporting the second belt member; and a second controller for controlling movement of an end of the second steering roller.

9 Claims, 12 Drawing Sheets

(a)

(b)

(a)

(b)

BELT DRIVING APPARATUS, AND IMAGE FORMING APPARATUS HAVING BELT DRIVING APPARATUS

FIELD OF THE INVENTION AND RELATED ART

The present invention relates to a belt driving apparatus which is mountable in an image forming apparatus such as an electrophotographic copy machine, an electrophotographic printer, etc., to drive multiple (two) belts which are in contact with each other. It also relates to an image forming apparatus in which the above-described belt driving apparatus is mountable.

There are various belt driving apparatuses which drive multiple (two) belts. One of such belt driving apparatuses is a fixing apparatus which is mounted in an image forming apparatus, such as an electrophotographic copy machine and an electrophotographic printer. More specifically, it is a fixing apparatus of the so-called belt-nip type. A fixing apparatus of this type has an endless heating belt and an endless pressing belt. The endless pressing belt (which hereafter may be referred to simply as pressure belt) is placed in contact with the heating belt (which hereafter may be referred to simply as fixation belt) to form a nip (Japanese Laid-open Patent Application 2007-079034). In operation, a sheet of recording medium which is bearing an unfixed toner image is conveyed through the nip while remaining pinched between the heating belt and pressing belt, whereby the unfixed toner image on the sheet of recording medium is thermally fixed to the sheet of recording medium. For size reduction and cost reduction, some fixing apparatuses of the belt-nip type are provided with only two (minimum number) rollers per belt. In other words, they are reduced in overall thermal capacity by using only two (minimum number) rollers per belt to minimize the length of time necessary for them to reach a temperature range in which they can properly fix a toner image.

There are serious technical issues regarding fixing apparatuses of the belt-nip type, that is, fixing apparatuses which use an endless fixing belt and/or an endless pressing belt. One of these technical issues is how to prevent the belts of a fixing apparatus of the belt-nip type from shifting (snaking) in a specific direction. More specifically, if the belts shift in the direction perpendicular to their moving direction while they are driven, problems result sometimes such that the belts move out of their preset range, and/or that the belts become damaged across their edge or edges. There are various methods for preventing an endless belt from excessively shifting in the direction perpendicular to its moving direction. One of these methods is to change in attitude one of the two rollers around which the endless belt is wrapped, in such a manner that one of the lengthwise ends of this roller is changed in position to cause the belt to remain in its preset positional range (Japanese Laid-open Patent Application H04-104180).

As described above, one of the methods for preventing the fixating belt and pressing belt of a fixing apparatus of the belt-nip type from excessively shifting in a specific direction is to structure the fixing apparatus so that the belt supporting rollers can be changed in attitude. However, if a fixing apparatus of the belt-nip type is structured so that its fixing belt and pressing belt can be changed in attitude by changing the upstream roller for the fixing belt, in terms of recording medium conveyance direction, and the upstream roller for the pressing belt, to change in position one of the lengthwise ends of the upstream roller for the fixing belt, and the corresponding lengthwise end of the upstream roller for the pressing belt, it is possible that when a sheet of recording medium is conveyed through the fixing apparatus by the belts, it will become unstable in attitude and behavior. The cause of this problem is that in a case of a fixing apparatus of the belt-nip type structured as described above, when the upstream fixation belt roller and upstream pressure belt roller are changed in attitude so that one of the lengthwise end of the upstream fixation belt roller and the corresponding lengthwise end of the upstream pressure belt roller come closer to each other, and when the upstream fixation belt roller and upstream pressure belt roller are changed in attitude so that one of the lengthwise end of the upstream fixation belt roller and the corresponding lengthwise end of the upstream pressure belt roller move away from each other, the amount by which the lengthwise ends are moved is rather large, and therefore, the amount by which the upstream fixation belt and upstream pressure belt are moved in the direction parallel to the lengthwise direction of the rollers to be corrected in their position is rather large, making it difficult for recording medium to remain stable in attitude and behavior while it is conveyed through the belt-nip. Therefore, in order to ensure that recording medium remains stable in attitude and behavior while it is conveyed through a fixing apparatus of the belt-nip type, it is desired to reduce the amount by which the distance between one end of the lengthwise ends of the upstream roller for the fixation belt, and the corresponding lengthwise end of the upstream roller for the pressure belt, that is, the distance between the fixation belt and pressure belt, on the upstream end of the fixing apparatus.

Not only does this problem occur to the fixation belt and pressure belt, but also, to any belt driving apparatus which has two (multiple) belts (which are in contact with each other), and is structured so that the two belts are prevented from excessively shifting in the direction perpendicular to their moving direction.

SUMMARY OF THE INVENTION

The primary object of the present invention is to provide a belt driving apparatus which is significantly smaller in the amount by which the distance between its first and second belts, on the recording medium entrance side of the apparatus, changes, and therefore, is significantly more stable in terms of recording medium conveyance than any of conventional belt driving apparatuses, and also, an image forming apparatus employing such a belt driving apparatus.

According to an aspect of the present invention, there is provided a belt driving apparatus comprising a first rotatable belt member; a first supporting member rotatably supporting said first belt member; a first steering roller, rotatably supporting said first belt member, for adjusting a position, with respect to a widthwise direction perpendicular to a rotational direction, of said first belt member, wherein one end of said first steering roller is fixed, and the other end thereof is movable; control means for controlling movement of the other end of said first steering roller; a second rotatable belt member contacted to said first belt member; a second supporting member rotatably supporting said second belt member; a second steering roller, rotatably supporting said second belt member, for adjusting a position, with respect to the widthwise direction, of said second belt member, wherein an end of said second steering roller remote from said one end of said first steering roller is fixed, and an end thereof adjacent the other end said second steering roller is movable; and control means for controlling movement of said end of said second steering roller adjacent the other end said second steering roller.

These and other objects, features, and advantages of the present invention will become more apparent upon consideration of the following description of the preferred embodiments of the present invention, taken in conjunction with the accompanying drawings.

BRIEF DESCRIPTION OF THE DRAWINGS

FIG. 8(*b*) is a left side (as seen from recording sheet entrance side) view of the fixation belt position control mechanism and pressure belt position control mechanism of the fixing apparatus shown in FIG. 8(*a*).

FIG. 9(*b*) is a left side (as seen from recording sheet entrance side) view of the fixation belt position control mechanism and pressure belt position control mechanism of the fixing apparatus shown in FIG. 9(*a*).

DESCRIPTION OF THE PREFERRED EMBODIMENTS

Embodiment 1

(1) General Description of Image Forming Apparatus

Figure 1:
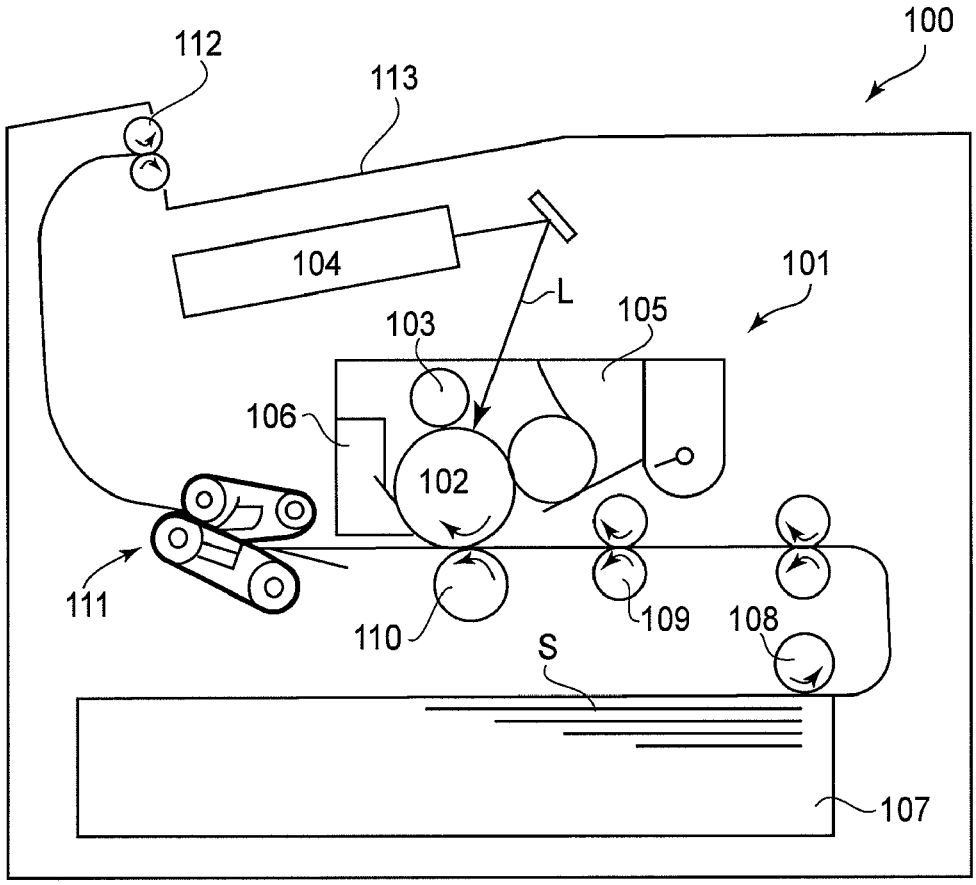
FIG. 1 is a schematic sectional view of a typical image forming apparatus to which the present invention is related. It shows the general structure of the apparatus.

Hereafter, the first preferred embodiment of the present invention will be described with reference to the appended drawings. FIG. 1 is a schematic sectional view of the image forming apparatus in the first embodiment of the present invention, the fixing apparatus of which is an image heating apparatus (device) in accordance with the present invention. It depicts the overall structure of the apparatus. The image forming apparatus depicted by FIG. 1 is an electrophotographic laser beam printer.

The image forming apparatus in the first embodiment can be roughly divided into an image forming portion 101 which forms a toner image on a sheet S (recording medium), and a fixing apparatus 111 (image heating apparatus) which fixes an unfixed toner image to the sheet S by heating and pressing the toner image. The image forming portion 101 has the following devices, which will be described next. They are an electrophotographic photosensitive member 102 (image bearing member), a charging device 103, an exposing apparatus 104 (exposing means), and a developing device 105 (developing means). The photosensitive member 102 is in the form of a drum, and therefore, will be referred to as a photosensitive drum hereafter. The charging device 103, exposing apparatus 104, and developing device 105 are in the adjacencies of the peripheral surface of the photosensitive drum 101. In an image forming operation, the peripheral surface of the photosensitive drum 101 is uniformly charged by the charging device 103. Then, the uniformly charged portion of the peripheral surface of the photosensitive drum 102 is exposed by the exposing apparatus 104. More specifically, the uniformly charged portion is scanned by a beam of laser light L projected by the exposing apparatus 104 while being modulated with the digital data of the image to be formed. Thus, an electrostatic latent image is formed on the charged portion of the peripheral surface of the photosensitive drum 101. This electrostatic latent image is developed by the developing device 105 which uses toner. Thus, a visible image is formed of toner on the peripheral surface of the photosensitive drum 102 (this visible image hereafter will be referred to simply as toner image).

The image forming apparatus 100 has also a recording sheet feeding-and-conveying cassette 107, which is in the bottom portion of the apparatus 100. The cassette 107 stores multiple sheets S in layers. As an image forming operation begins, the sheets S in the cassette 107 are fed into the main assembly of the apparatus 100 one by one, and conveyed to a pair of registration rollers 109, by a pair of sheet feeder rollers 108. Then, each sheet S is conveyed to a transfer nip which is between the photosensitive drum 102 and a transfer roller 110 (transferring means), by the pair of registration rollers 109 in synchronism with the arrival of the toner image on the photosensitive drum 102 at the transfer nip. Then, the sheet S is conveyed through the transfer nip while remaining pinched by the peripheral surface of the photosensitive drum 102 and the peripheral surface of the transfer roller 110. While the sheet S is conveyed through the transfer nip, the toner image on the peripheral surface of the photosensitive drum 102 is electrostatically transferred onto the sheet S by the transfer roller 110. In other words, the unfixed toner image is borne on one of the surfaces of the sheet S. Then, the sheet S bearing the unfixed toner image is conveyed to the fixing apparatus 111, and is conveyed through the fixing apparatus 111. In the fixing apparatus 111, heat and pressure are applied to the unfixed toner image, whereby the unfixed toner image becomes thermally fixed to the sheet S. Then, the sheet S, bearing the fixed toner image, is conveyed by the fixing apparatus 111 to a pair of discharge rollers 112. Then, the sheet S is discharged by the pair of discharge rollers 112 into a delivery tray 113 which makes up a part of the top portion of the image forming apparatus. The transfer residual toner, that is, the toner remaining on the peripheral surface of the photosensitive drum 102 after the transfer of the unfixed toner image onto the sheet S, is removed by a cleaning apparatus 106 (cleaning means).

(2) Description of Fixing Apparatus

In the following description of the fixing apparatus and its structural members, the "lengthwise direction" means the direction perpendicular to the sheet conveyance direction (recording medium conveyance direction), whereas the "widthwise direction" means the direction parallel to the sheet conveyance direction. The "length" of a given member means the measurement of the member in the "lengthwise direction," whereas the "width" of a given member means the measurement of the member in the "widthwise direction".

Figure 2:
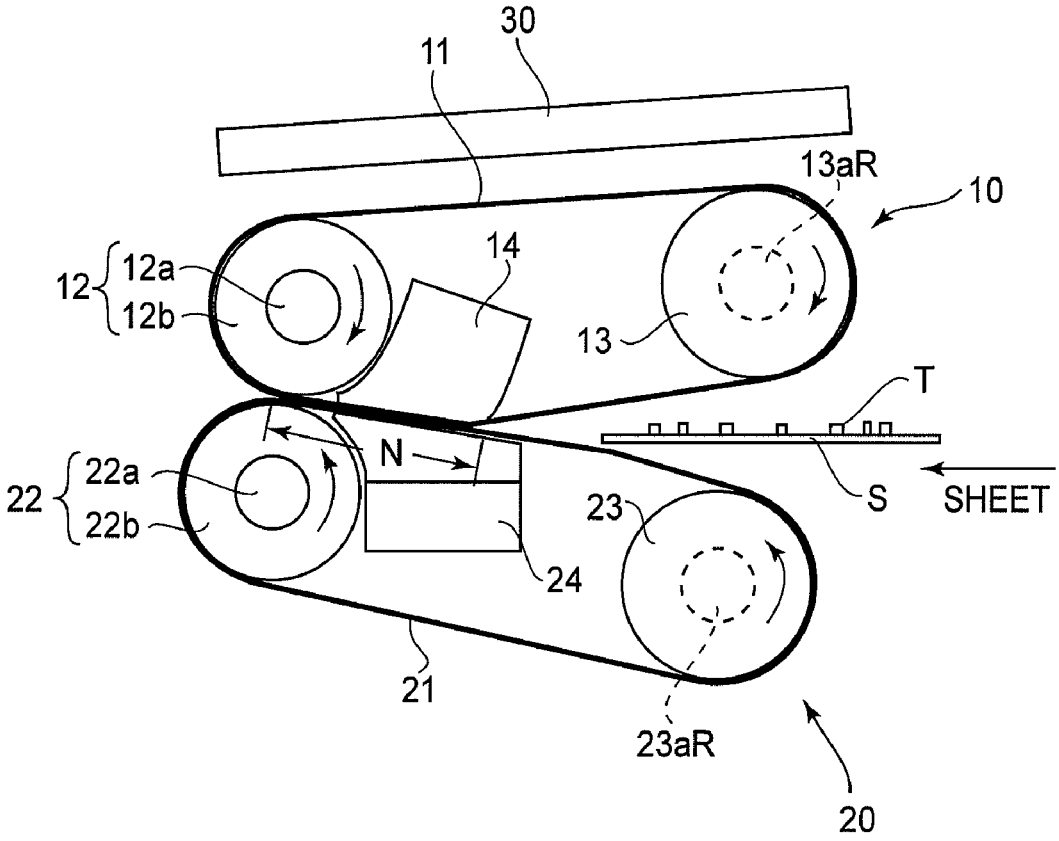
FIG. 2 is a schematic sectional view (at plane perpendicular to moving direction of belts) of the fixing apparatus in the first preferred embodiment of the present invention, and shows the general structure of the apparatus.

FIG. 2 is a schematic sectional view of the fixing apparatus, at a plane perpendicular to the lengthwise direction, and shows the general structure of the apparatus. This fixing apparatus is of the belt-nip type. That is, it has a belt driving apparatus, and a pair of belts which are placed in contact with each other to form a nip.

The fixing apparatus 111 in the first embodiment has a fixation belt unit 10 and a pressure belt unit 20. The fixation belt unit 10 has a fixation belt 11, which is an endless belt and is one (first) of the two belts of the fixing apparatus 111. The fixation belt 11 is supported by a pair of rollers 12 and 13 in such a manner that it can be circularly moved. It is kept stretched also by the pair of rollers 12 and 13 which apply a preset amount of tensile force (120 N for example) to the fixation belt 11. The roller 12 is a fixation belt driving roller, whereas the roller 13 is a fixation belt steering roller. In other words, the roller 13 has a function of steering the fixation belt 11 and a function of keeping the fixation belt 11 stretched. The fixation belt 11 is a laminar belt. It is made up of a metallic substrate layer, and a silicon rubber layer coated on the substrate layer. The substrate layer is 75 μm in thickness, 380 mm in width, and 200 mm in length. It is made of a magnetic metallic substance such as nickel or stainless steel. The silicon rubber layer is 300 μm in thickness. The fixation belt 11 does not need to be limited in structure and material to the above described ones. That is, any belt may be employed, as long as it is heat resistant and can generate heat by being subjected to the magnetic flux generated by an inductive heating coil 30 as a heat generation source, as will be described later. The fixation belt driver roller 12 is made up of a metallic core 12*a* and an elastic layer 12*b*. The metallic core 12*a* is a solid cylindrical member made of stainless steel, and is 18 mm in external diameter. The elastic layer 12*b* is made of heat resistant silicon rubber, and was molded on the peripheral surface of the metallic core 12*a* in a manner to entirely cover the peripheral surface of the metallic core 12*a*. The fixation belt steering roller 13 is made up of a hollow roller made of stainless steel, for example, and is 20 mm in external diameter and roughly 18 mm in internal diameter. The fixation belt steering roller 13 has the belt steering function and belt tensioning function as described previously. That is, not only does the fixation belt steering roller 13 function as a steering roller for correcting the fixation belt 11 in the position in the "lengthwise direction" of the fixing apparatus 111 (widthwise direction of belt 11), but also, it functions as a belt tensioning roller for adjusting the fixating belt 111*n* tension.

The pressure belt unit 20 has an endless pressure belt as the second belt (FIG. 2) of the fixing apparatus 111. The pressure belt 21 is supported by a pair of rollers 22 and 23, as supporting members, in such a manner that it can be circularly moved. It is kept stretched also by the pair of rollers 22 and 23 which apply a preset amount of tensile force (100 N for example) to the pressure belt 21. The roller 22 is a pressure belt driving roller, whereas the roller 23 is a pressure belt steering roller. In other words, the roller 23 has a function of steering the pressure belt 21 and a function of keeping the pressure belt 21 stretched. The pressure belt 21 also is a laminar belt. It is made up of a substrate layer, and a silicon rubber layer coated on the substrate layer. The substrate layer is 75 μm in thickness, 380 mm in width, and 200 mm in length. It is made of polyimide film. The silicon rubber layer is 300 μm in thickness. The pressure belt 21 does not need to be limited in structure and material to the above described ones. That is, any belt may be employed as the pressure belt 21, as long as it is heat resistant. The pressure belt driving roller 22 is a solid roller made of stainless steel, for example, and is 20 mm in external diameter. The pressure belt steering roller 23 is made up of a hollow roller made of stainless steel, for example, and is 20 mm in external diameter and roughly 18 mm in internal diameter. The pressure belt steering roller 23 has the belt steering function and belt tensioning function as described previously. That is, not only does the pressure belt steering roller 23 function as a steering roller for correcting the pressure belt 21 in its position in the "lengthwise direction" of the fixing apparatus 111 (widthwise direction of belt 21), but also, it functions as a belt tensioning roller for adjusting the pressure belt in tension.

The fixation belt 11 is suspended by the fixation belt driving roller 12 and fixating belt steering roller 13 in such a manner that the portion of the fixation belt 11, which is moving through the top portion of the loop it forms, remains roughly horizontal. The pressure belt 21 is under the fixation belt 11, and is in contact with the fixation belt 11. It is suspended by the pressure belt driving roller 22 and pressure belt steering roller 23 in such a manner that its portion which is moving through the top portion of the loop it forms, is tilted in such a manner that its upstream end, in terms of the moving direction of the fixation belt 21, is positioned lower than its downstream end. The pressure belt driving roller 22 opposes the fixation belt driving roller 12 with the presence of the fixation belt 11 and pressure belt 21 between the two rollers 22 and 12. It is kept pressed against the fixation belt driving roller 12 by a pair of springs 71F and 71R (which will be described later) so that the outward surface of the pressure belt 21 is kept in contact with the outward surface of the fixation belt 11. That is, the pressure from the springs 71F and 71R is applied to the elastic layer 12*b* of the fixation belt driving roller 12 through the pressure belt 21 and fixation belt 11, whereby the elastic layer 21*b* is elastically deformed, forming thereby a part of the fixation nip N. The fixation belt unit 10 is provided with a stay 14 (pressure applying member) formed of stainless steel (SUS), for example. The stay 14 is on the inward side of the fixation belt loop, and is positioned so that its lengthwise direction coincides with the widthwise direction of the fixation belt 11. The pressure belt unit 11 is provided with a pressure pad 24 (pressing member) formed of silicon rubber, for example. The stay 24 is in on the inward side of the pressure belt loop, and is positioned so that its lengthwise direction coincides with the widthwise direction of the pressure belt 21. The stay 14 opposes the pressure pad 24 with the presence of the fixation belt 11 and pressure belt 21 between the stay 14 and pressure pad 24. More specifically, the stay 14 is kept pressed upon the inward surface of the fixation belt 11 by unshown compression springs so that a preset amount (400 N, for example) of contact pressure is maintained between the stay 14 and fixation belt 11. The pressure pad 24 is kept pressed upon the inward surface of the pressure belt 21 and the peripheral surface of the pressure belt driving roller 22 so that a preset mount (400 N, for example) of contact pressure is maintained between the pressure pad 24 and pressure belt 21, and between the pressure pad 24 and the pressure belt driving roller 22. By not only pressing stay 14 upon the inward surface of the fixation belt 11, but also pressing the pressure pad 24 upon the inward surface of the pressure belt 21 and peripheral surface of the pressure belt driving roller 22, it is possible to provide a long area of contact between the outward surface of the fixation belt 11 and the outward surface of the pressure belt 21 in terms of the sheet conveyance direction. In other words, it is possible to form a large fixation nip N, the size of which is proportional to the size of the abovementioned area of contact, by the outward surface of the fixation belt 11 and the outward surface of the pressure belt 21. With the formation of the long and wide fixation nip N, it is possible to make longer the length of time it takes for the sheet S, which is bearing an unfixed toner image T, to be conveyed through the fixation nip N while remaining pinched between the two belts 11 and 21. Therefore, toner images which are significantly superior in glossiness than those obtainable with the use of any of conventional fixing apparatuses, can be outputted at a significantly higher speed than those reachable by any of conventional fixing apparatuses.

The typical operation of the fixing apparatus 111 in this embodiment is as follows. As the fixation belt driving roller 12 is rotated by a fixation motor, it circularly moves the fixation belt 11 in the direction indicated by an arrow mark (FIG. 2). The force given to the fixation belt 11 by the fixation motor through the fixation belt driving roller 12 is transmitted from the fixation belt 11 to the pressure belt 21 through the fixation nip N, whereby the pressure belt 21 is rotated in the direction indicated by the arrow mark. In other words, the pressure belt 21 is rotated by the circular movement of the fixation belt 11. Through the inductive heating coil 30, high frequency electric current is flowed from an exciter circuit, causing the inductive heating coil 30 to generate magnetic flux, which heats the fixation belt 11. The surface temperature of the fixation belt 11 is detected by a temperature detecting member, such as a thermistor, which is in the adjacencies of the surface of the fixation belt 11. The output signal from the temperature detecting member is picked up by a control portion 200 made up of a CPU and memories, such as a RAM, a ROM, and the like. Then, the control portion 200 controls the exciter circuit, based on the output signals, so that the surface temperature of the fixation belt 11 remains in a preset fixation temperature range (target temperature range). While the surface temperature of the fixation belt 11 is kept in the preset fixation range, the sheet S on which the unfixed toner image T is present is introduced into the fixation nip N of the fixing apparatus 111 with the toner image bearing surface of the sheet S facing upward, and is conveyed through the fixation nip N while remaining pinched by the outward surface of the fixation belt 11 and the outward surface of the pressure belt 21. While the sheet S is conveyed through the fixation nip N, the sheet S and the unfixed toner image T thereon are subjected to the heat from the fixation belt 11 and the pressure from the combination of the pressure belt 21 and fixation belt 11. Thus, the toner image T becomes thermally fixed to the surface of the sheet S.

Figure 3A:
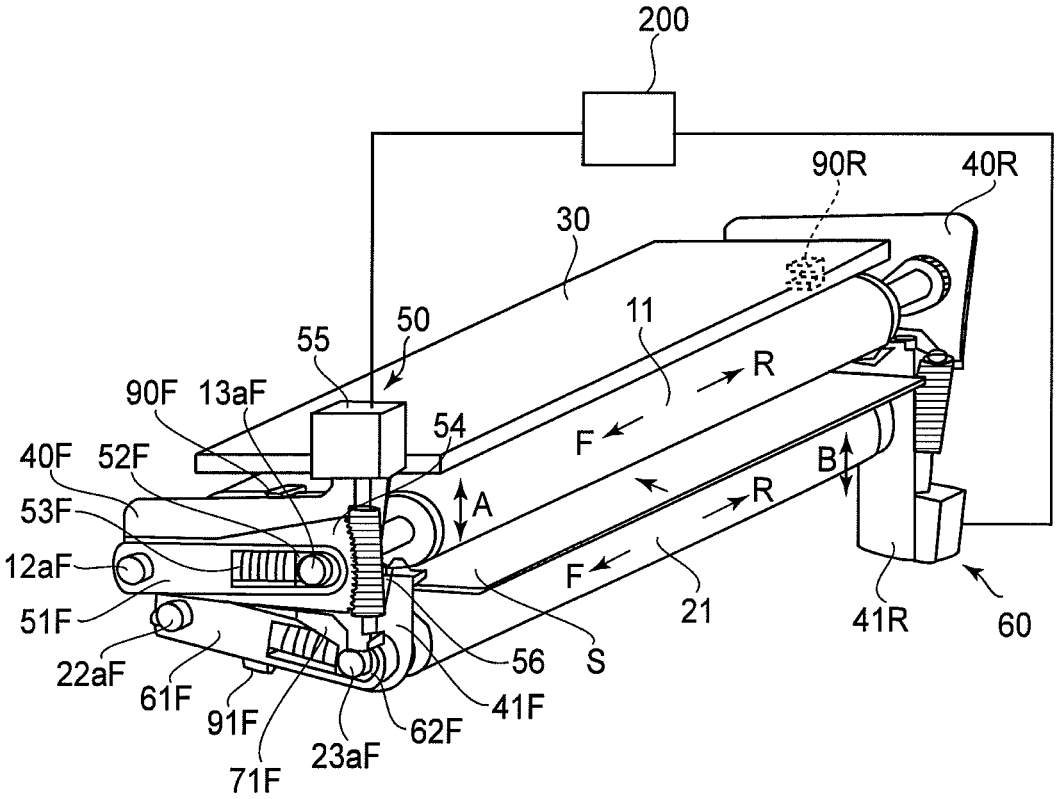
FIG. 3A is an external perspective view of the combination of the mechanism for controlling the fixation belt in position, and the mechanism for controlling the pressure belt in position, as seen from the recording sheet entrance side, and shows the structure of the mechanisms.
Figure 3C:
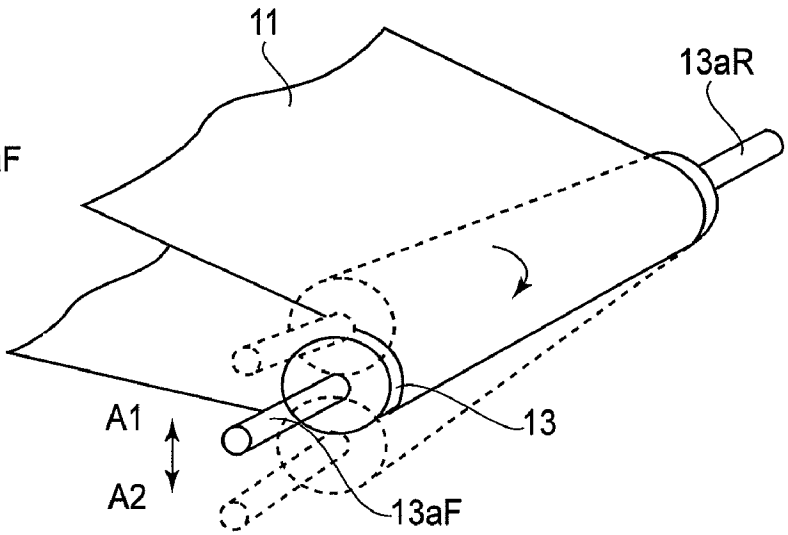
FIG. 3C is a schematic drawing which depicts the movement of the pressure belt steering roller of the mechanism for controlling the pressure belt in position.
Figure 3B:
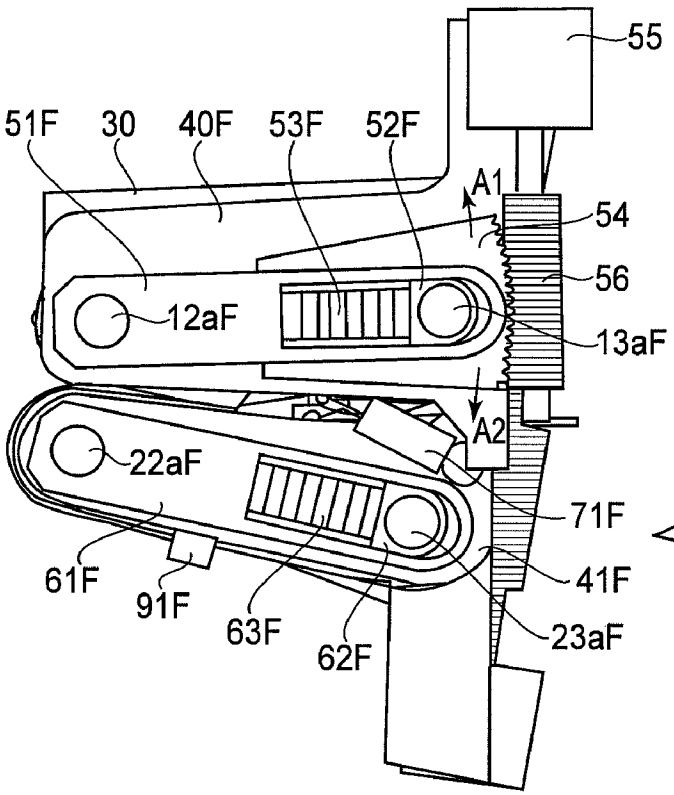
FIG. 3B is a left side view of the combination of the mechanism for controlling the fixation belt in position, and the mechanism for controlling the pressure belt in position, as seen from the recording sheet entrance side, and shows the structure of the mechanisms.
Figure 4A:
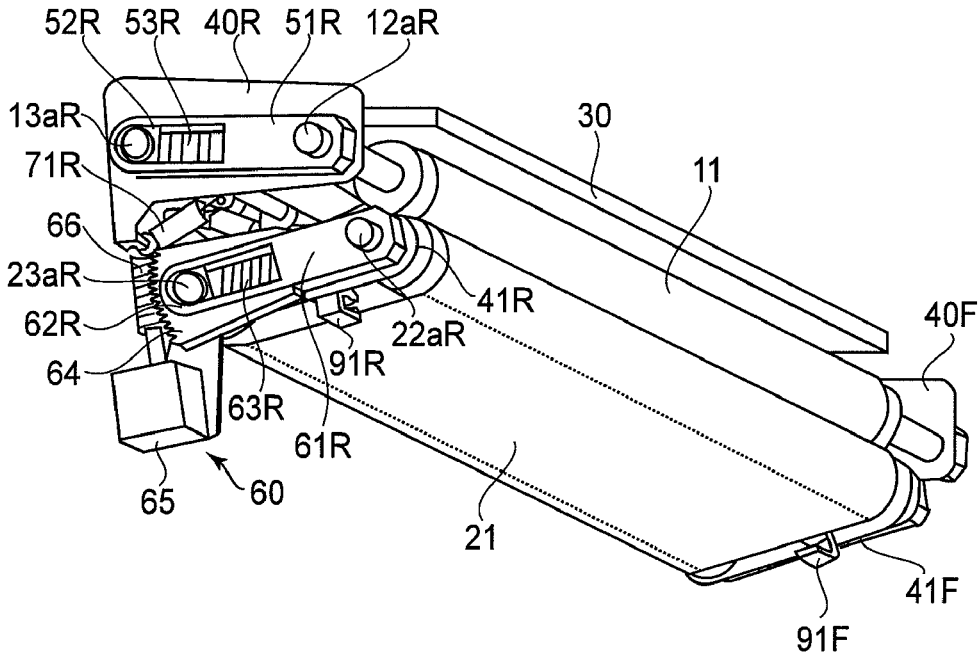
FIG. 4A is an external perspective view of the combination of the mechanism for controlling the fixation belt in position, and the mechanism for controlling the pressure belt in position, as seen from the recording sheet exit side, and shows the structure of the mechanisms.
Figure 4C:
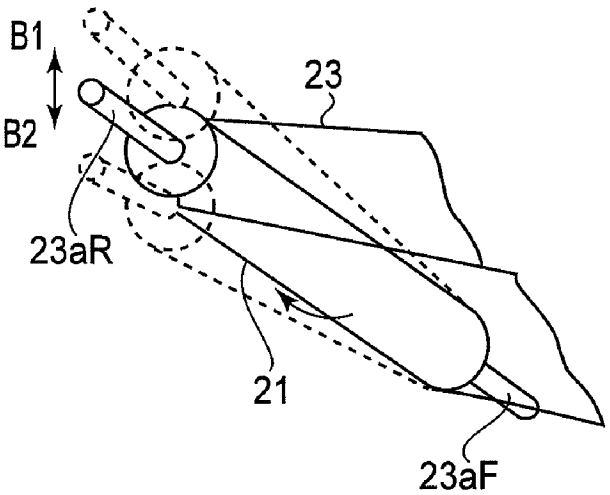
FIG. 4C is a schematic drawing which depicts the movement of the pressure belt steering roller of the mechanism for controlling the pressure belt in position.
Figure 4B:
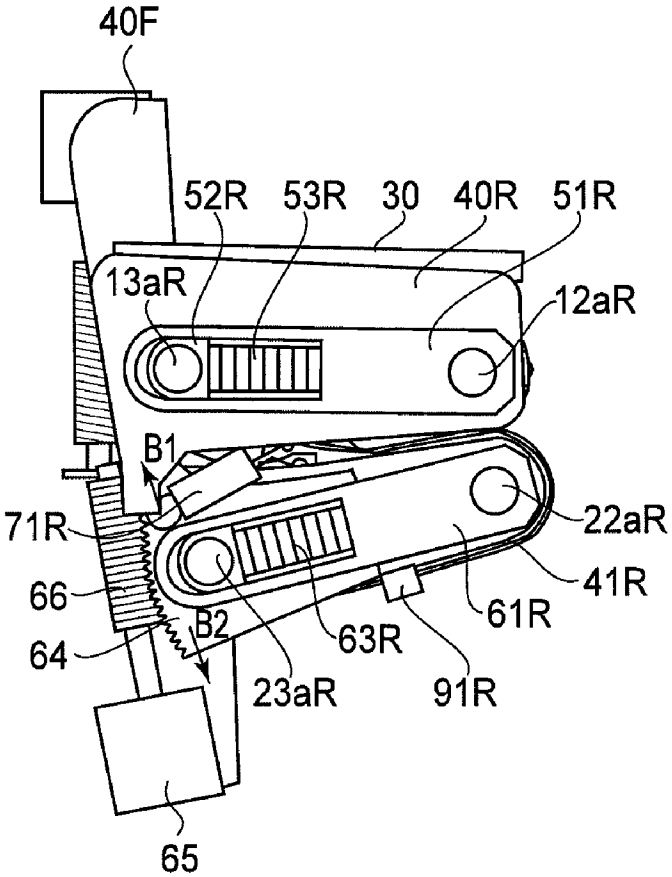
FIG. 4B is a left side view of the combination of the mechanism for controlling the fixation belt in position, and the mechanism for controlling the pressure belt in position, as seen from the recording sheet exit side, and shows the structure of the mechanisms.

(3) Description of Fixation Belt Position Control Mechanism and Pressure Belt position Control Mechanism FIG. 3A is an external perspective view of the combination of the mechanism for controlling the fixation belt in position, and the mechanism for controlling the pressure belt in position, as seen from the recording sheet entrance side, and shows the structure of the mechanisms. FIG. 3B is a left side view of the combination of the mechanism for controlling the fixation belt in position, and the mechanism for controlling the pressure belt in position (shown in FIG. 3A), as seen from the recording sheet entrance side, and shows the structure of the mechanisms. FIG. 3C is a schematic drawing which depicts the movement of the pressure belt steering roller of the mechanism for controlling the pressure belt in position. FIG. 4A is an external perspective view of the combination of the mechanism for controlling the fixation belt in position, and the mechanism for controlling the pressure belt in position, as seen from the recording sheet exit side, and shows the structure of the mechanisms. FIG. 4B is a left side view of the combination of the mechanism for controlling the fixation belt in position, and the mechanism for controlling the pressure belt in position, as seen from the recording sheet exit side, and shows the structure of the mechanisms. FIG. 4C is a schematic drawing which depicts the movement of the pressure belt steering roller of the mechanism for controlling the pressure belt in position.

First, the mechanism 50 (first correctional means) for controlling the fixation belt in position will be described. This mechanism 50 will be referred to hereafter as a fixation belt position controlling means 50. The fixation belt position controlling means 50 has a pair of lateral plates 40F and 40R (front and rear plates 40F and 40R), a pair of steering roller supporting arms 51F and 51R, the fixation belt driving roller 12, and the fixation belt steering roller 13. The steering roller supporting arms 51F and 51R are attached to the front and rear plates 40F and 40R, respectively. The front end of metallic core 12*a*F of the fixation belt driving roller 12 and the front end 13*a*F of the metallic core 13*a* of the fixation belt steering roller 13 are supported by the steering roller supporting arm 51F. The fixation belt steering roller 13 is supported in such a manner that the fixation belt steering roller 13 can be tilted to vertically move the front end 13*a*F of its metallic core 13*a*. More specifically, the fixation belt driving roller 12 is rotatably supported by the front plate F of the fixing apparatus 111, and the steering roller supporting arm 51F of the fixation belt position controlling mechanism 50 of the fixing apparatus 111, by the lengthwise front end portion 12*a*F of its metallic core 12*a* (FIGS. 3A and 3B). Further, the fixation belt driving roller 12 is rotatably supported by the rear plate 40R of the fixing apparatus 111 and the steering roller supporting arm 51R of the fixation belt position control mechanism 50, by the other lengthwise end (right lengthwise end) 12*a*R of the metallic core 12*a* (FIGS. 4A and 4B). The lengthwise end 13*a*F of the metallic core 13*a* of the fixation belt steering roller 13 is rotatably supported by the front plate 41F of the fixing apparatus 111, and the steering roller supporting front arm 51F of the fixing apparatus 111, with the placement of a bearing 52F between the metallic core end 13*a*F and steering roller supporting arm 51F to make the fixation belt steering roller 13 rotatable (FIGS. 3A and 3B). The rear end 13*a*R of the metallic core 13*a* of the fixation belt steering roller 13 is rotatably supported by the rear plate 41R of the fixing apparatus 111, and the steering roller supporting rear arm 51R, with the placement of a bearing 52R between the rear front end 13*a*R of the metallic core 13*a*, and the fixation belt steering roller supporting rear arm 51R (FIGS. 4A and 4B). The bearing 52F is supported by the steering roller supporting arm 51F on the front plate 40F in such a manner that the bearing 52F can be slid in the direction in which the fixation belt 11 is kept stretched (FIGS. 3A and 3B). The frontal plate 40F is provided with a hole through which the front end portion 13*a*F of the metallic core 13*a* of the fixation belt steering roller 13 is put. The hole is shaped so that as the fixation belt steering roller 13 is tilted to steer the fixation belt 11, the front end portion 13*a*F is allowed to be vertically displaced. Further, a tension spring 53F for keeping the bearing 52F pressed in the belt tensioning direction to provide the fixation belt 11 with a preset amount of tension is attached to the steering roller support arm 51F. Therefore, of the steering roller support arm 51F and 51R, the steering roller support arm 51F can tilt the fixation belt driving roller 12 in such a manner that the front end 12*a*F of the metallic core 12*a* of the fixation belt driving roller 12 vertically displaces in an oscillatory manner. Thus, the fixation belt steering roller 13 can be tilted in such a manner that the lengthwise end 13*a*R, by which the fixation belt steering roller 13 is supported by the steering roller support arm 51R, is moved upward or downward as indicated by a pair of arrow marks A1 or A2, respectively, to steer the fixation belt 11 by a preset amount (FIG. 3B). That is, the fixation belt position control mechanism 50 is structured so that as the steering roller support arm 51F is moved in an oscillatory manner, the fixation belt steering roller 13 tilts by a preset angle in such a manner, that the lengthwise end 13*a*F of the metallic core 13*a* of the fixation belt steering roller 13 moves upward or downward indicated by the pair of arrow marks A1 and A2, respectively (FIG. 3C). The steering roller support arm 51F is provided with a fan-shaped gear 54, the gear portion of which faces away from the metallic core 13*a*. The fan-shaped gear 54 is in engagement with a worm gear 56 attached to the output shaft of a stepping motor 55. Further, the steering roller support arm 51R supported by the rear plate 40R is fitted with a bearing 52R, which is supported by the steering roller support arm 51R in such a manner that it is slid in the belt tension direction (FIGS. 4A and 4B). It is by this bearing 52R that the lengthwise rear end portion 13*a*R of the metallic core 13*a* of the fixation belt steering roller 13, which is put through the rear plate 40R in such a manner that it cannot be moved upward or downward, is rotatably supported. Further, the steering roller support arm 51R is fitted with a tension spring 53R for keeping the bearing 52R pressed in the belt tension direction to provide the fixation belt 11 with a preset amount of tension.

There is a fixation belt position sensor 90F (belt position detecting first member) for detecting the position of front edge of the fixation belt 11, on the inward surface of the front plate 40F. The fixation belt position sensor 90F is structured so that it can detect the presence of front edge of the fixation belt 11 when the edge is within its preset range, and at the preset limit position in terms of the lengthwise direction of the fixation belt driving roller 13 and fixation belt steering roller 13. There is also a fixation belt position sensor 90R (belt position detecting first member) for detecting the position of rear edge of the fixation belt 11, on the inward surface of the front plate 40F. The fixation belt position sensor 90R is structured so that it can detect the presence of the rear edge of the fixation belt 11 when the edge is within its preset range, and at the preset limit position, in terms of the lengthwise direction of the fixation belt driving roller 12 and fixation belt steering roller 13. The abovementioned preset limit position is on the outward side of the preset range, in terms of the lengthwise direction of the fixation roller driving roller 12 and fixation roller steering roller 13. As for the angle of the tilt of the fixation belt steering roller 13, the output of the fixation belt position sensor 90F and that of the fixation belt position sensor 90R are inputted into the control portion 200 (controlling means) so that the control portion 200 can control the operation of the stepping motor 55 to keep the fixation belt steering roller 13 in a preset range in terms of tilt.

Next, the mechanism 60 (second controlling means) for controlling the pressure belt in position will be described. This mechanism hereafter will be referred to as a pressure belt position control mechanism 60. The pressure belt position control mechanism 60 is made up of a front plate 41F, a rear plate 41R, a pair of steering roller supporting arms 61F and 61R, the pressure belt driving roller 22, and the pressure belt steering roller 23. The steering roller supporting arms 61F and 61R are attached to the front and rear plates 41F and 41R, respectively. The pressure belt driving roller 22 and pressure belt steering roller 23 are supported by the front and rear plates 41F and 41R. The rear end portion 22*a*R of the metallic core 22*a* of the pressure belt driving roller 22 and the rear end portion 13*a*R of the metallic core 13*a* of the pressure belt steering roller 23 are supported by the steering roller support arm 61R. The pressure belt steering roller 23 is supported in such a manner that the pressure belt steering roller 23 can be tilted to vertically move the rear end 23*a*R of its metallic core 23*a*. The front end portion 23*a*F of the metallic core 23*a* of the pressure roller driving roller 23 is rotatably supported by the front plate 41F of the fixing apparatus 111, and the steering roller support arm 61F of the pressure belt position control mechanism 60 of the fixing apparatus 111 (FIGS. 3A and 3B). The other lengthwise end portion 23*a*R of the metallic core 23*a* of the pressure belt driving roller 23 is rotatably supported by the rear plate 41R of the fixing apparatus 111 and the steering roller support arm 61R of the pressure belt position control mechanism 60 of the fixing apparatus 111 (FIGS. 4A and 4B). The lengthwise front end portion 23*a*F of the metallic core 23*a* of the pressure belt steering roller 23 is rotatably supported by the front plate 41F of the fixing apparatus 111 and the steering roller support arm 61F of the fixing apparatus 111, with the presence of a bearing 62F between the metallic core end portion 23*a*F and steering roller support arm 62F (FIGS. 3A and 3B). The lengthwise other end portion 23*a*R of the metallic core 23*a* of the pressure belt steering roller 23 is rotatably supported by the rear plate 41R of the fixing apparatus 111 and the steering roller support arm 61R, with the presence of a bearing 62R between the metallic core end portion 23*a*R and steering roller support arm 61R (FIGS. 4A and 4B). The bearing 62R is supported by the steering roller support arm 61R attached to the rear plate 41R, in such a manner that it can be slid in the belt tension direction (FIGS. 4A and 4B). Further, the metallic core end portion 23*a*R of the pressure belt steering roller 23 is put through the rear plate 40R and is rotatably supported by the bearing 62R. The steering roller support arm 61R is fitted with a tension spring 63R for keeping the bearing 61R pressed in the belt tension direction to provide the pressure belt 21 with a preset amount of tension. Therefore, of the pair of steering roller support arm 61F and 61R, the steering roller support arm 61R is rotationally movable about the axis of the metallic core end portion 22*a*R of the pressure belt driving roller 22. Therefore, the steering roller support arm 61R is rotationally (virtually vertically) movable about the axis of the metallic core end portion 22*a*R of the pressure belt driving roller 22. Therefore, the pressure belt steering roller 23 can be tilted (rotationally moved) about the center of the lengthwise metallic core end portion 23*a*F of the pressure belt steering roller 23, which is supported by the steering roller supported by the steering roller support arm 61F, so that the rear end portion 23*a*R of the metallic core 23*a* of the pressure belt steering roller 23 moves in the upward or downward direction as indicated by a pair of arrow marks B1 and B2, respectively, to steer the pressure belt 21 by a preset amount (FIG. 4B). That is, the pressure belt steering mechanism 60 is structured so that as the steering roller support arm 61R is rotationally moved, the pressure belt steering roller 23 is rotationally moved (tilted) by a preset angle (amount) about the center of the front end portion 23*a*F of the metallic core 23*a* of the pressure belt steering roller 23, in the upward or downward direction indicated by the pair of arrow marks. B1 and B2, respectively (FIG. 4C). The steering roller support arm 61R is provided with a fan-shaped gear 64, which is on its surface facing away from its rotational axis. The fan-shaped gear 64 is in mesh with a worm gear 66 attached to the output shaft of a stepping motor 65 (for pressure belt steering roller) supported by the rear plate 41R. Further, steering roller support arm 61F attached to the front plate F is fitted with a bearing 62F in such a manner that the bearing 62F can be slid in the belt tension direction (FIGS. 4A and 4B). It is by the bearing 62F that the front end portion 23*a*F of the metallic core 23*a* of the pressure belt steering roller 23, which is put through the front plate F in such a manner that it cannot be vertically moved, is rotatably supported. Further, the steering roller support arm 61F is fitted with a tension spring 63F for keeping the bearing 62F pressed in the belt tension direction to provide the pressure belt 21 with a preset mount of tension.

There is a pressure belt position sensor 91R (belt position detecting second member) for detecting the position of the rear edge of the pressure belt 13, on the inward surface of the rear plate 41R. The pressure belt position sensor 91R is structured so that it can detect in position the range in which the lengthwise rear edge of the pressure belt 13 is allowed to move, and the preset positional limit. There is also a pressure belt position sensor 91F (belt position detecting second member) for detecting the position of the front edge of the pressure belt 13, on the inward surface of the front plate 41F. The pressure belt position sensor 91R is structured so that it can detect in position the range in which the front edge of the fixation belt steering roller 13 is allowed to move, and the positional limit for the shifting of the pressure belt 21. The above-mentioned position limit for the shifting of the pressure belt 21 is on the outward side of the preset range for the shifting of the pressure belt 13, in terms of the lengthwise direction of the pressure belt driving roller 22 and pressure roller steering roller 23. As for the angle of the tilt of the pressure roller steering roller 23, the outputs of the pressure belt position sensors are inputted into the control portion 200 (controlling means) so that the control portion 200 can control the operation of the stepping motor 65 to keep the pressure roller steering roller 23 in a preset range in terms of tilt.

Figure 5:
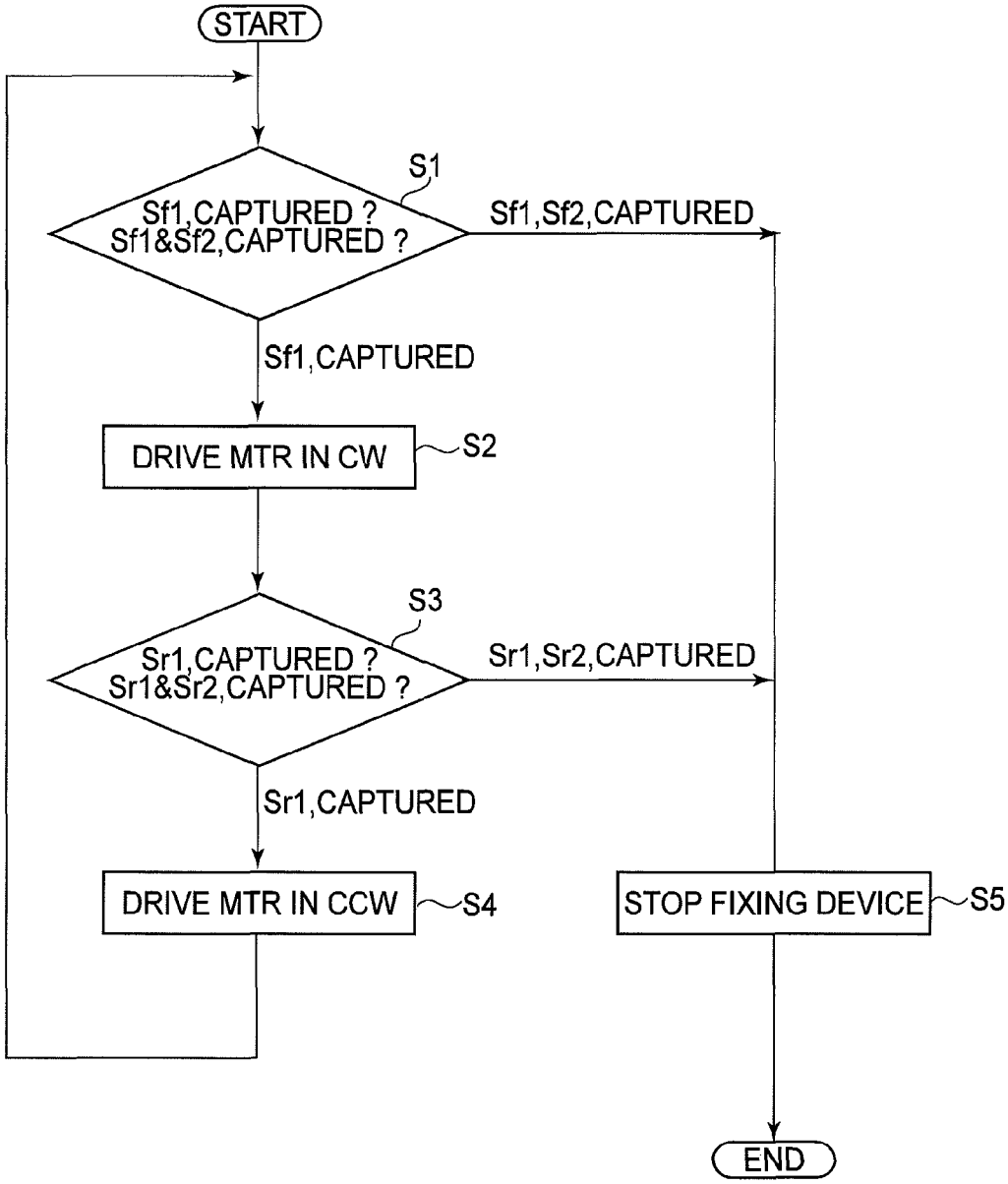
FIG. 5 is a flowchart of the sequence for controlling the mechanism for controlling in position the fixation belt of the fixing apparatus in the first embodiment.
Figure 6:
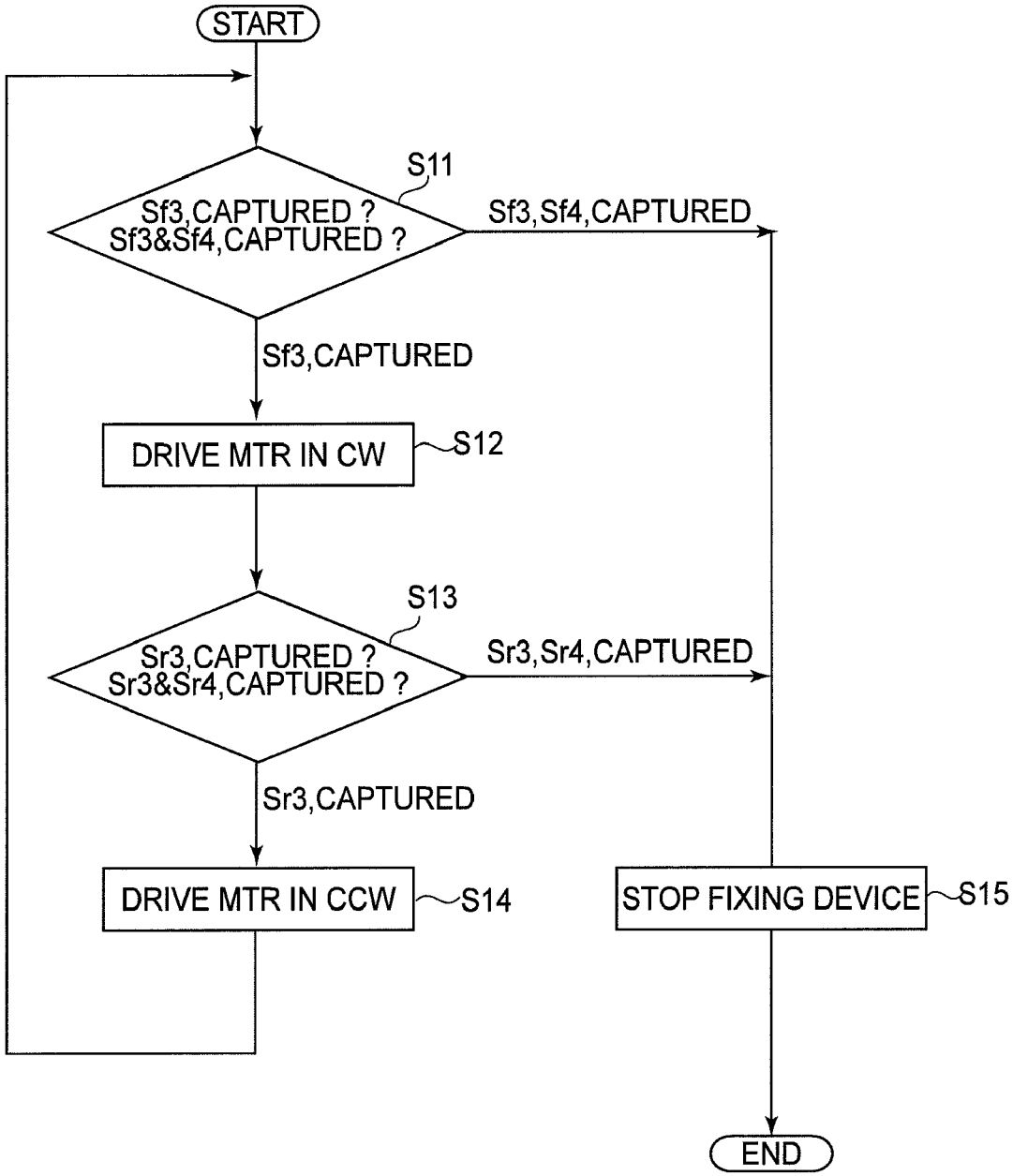
FIG. 6 is a flowchart of the sequence for controlling the mechanism for controlling in position the pressure belt of the fixing apparatus in the first embodiment.

(4) Description of Belt Position Control of Fixation Belt Position Control Mechanism and Pressure Belt Position Control Mechanism FIG. 5 is a flowchart of an example of belt position control of the fixation belt position control mechanism. FIG. 6 is a flowchart of an example of the belt position control of the pressure belt position control mechanism.

First, referring to FIG. 5, the belt position control carried out by the control portion 200 to control the fixation belt position controlling means 50 will be described. Referring to FIG. 3A, if the front edge of the fixation belt 11 moves out of the preset range for the front edge of the fixation belt 11 because of the shifting of the fixation belt 11 in the direction indicated by an arrow mark F, for example, the fixation belt position sensor 90F detects the position of the front edge of the fixation belt 11, and outputs a signal Sf1. Further, if the other edge of the fixation belt 11 moves out of the range preset for the fixation belt 11, the fixation belt position sensor 90R detects the position of the other edge of the fixation belt 11, and outputs a signal Sf2.

In step S1, as the signal Sf1 outputted from the fixation belt position sensor 90F is picked up by the control portion 200, the control portion 200 moves to step S2. If the control portion 200 takes in the signals Sf1 and Sf2, it takes step S5. In step S2, the control portion 200 rotates the stepping motor 55 in the direction to cause the output shaft of the stepping motor 55 to rotate in the direction indicated by an arrow mark CW. The rotation of the output shaft of the stepping motor 55 causes the worm gear 56, whereby the steering roller supporting arm 51F is rotationally moved, along with the fan-shaped gear 54, in the downward direction indicated by an arrow mark A2. As the steering roller supporting arm 51F is rotationally moved in the direction indicated by the arrow mark A2, the fixation belt steering roller 13 is tilted by the movement of the steering roller supporting arm 51F, in the direction to cause its front end to move also in the direction indicated by the arrow mark A2. As the fixation belt steering roller 13 is tilted as described above, the fixation belt 11 begins to shift toward the other end, that is, in the direction indicated by the arrow mark R. If the other edge of the fixation belt 11 moves beyond the preset range for the other edge, the edge is detected by the fixation belt position sensor 90R, and the fixation belt position sensor 90R outputs a signal Sr2. In step S3, as the control portion 200 takes in the signal Sr1 from the fixation belt position sensor 90R, it proceeds to step S4, whereas if the control portion 200 takes in signals Sr1 and Sr2, the control portion 200 proceeds to step S5. In step S4, in response to the signal Sr1, the control portion 200 rotates the stepping motor 55 in the direction to cause the output shaft of the stepping motor 55 rotates in the direction indicated by an arrow mark CC. The rotation of the output shaft of the stepping motor 55 causes the worm gear 56, whereby the steering roller supporting arm 51F is rotationally moved, along with the fan-shaped gear 54, in the direction indicated by the arrow mark A1. As the steering roller supporting arm 51F is rotationally moved in the direction indicated by the arrow mark A1, the fixation belt steering roller 13 is tilted by the movement of the steering roller supporting arm 51F, in the direction to cause its front end to move also in the direction indicated by the arrow mark A1. As the fixation belt steering roller 13 is tilted as described above, the fixation belt 11 begins to shift toward the other end, that is, in the direction indicated by the arrow mark R. If the front edge of the fixation belt 11 moves beyond the preset range for the front edge, the edge is detected by the fixation belt position sensor 90F, and the fixation belt position sensor 90F outputs a signal Sf1. If the other edge of the fixation belt 11 moves beyond the preset range for the other edge, the edge is detected by the fixation belt position sensor 90R, and the fixation belt position sensor 90R outputs the signal Sf2. In step S1, as the control portion 200 takes in the output signal Sf1 of the fixation belt position sensor 90F, it moves to step S2, whereas if it takes in output signals Sf1 and Sf2, it moves to step S5. The processes in steps S2-S4 are repeatedly carried out. Thus, the fixation belt 11 continuously and alternately sways frontward and rearward (it continues to snake) while remaining in the preset range in which the fixation belt 11 is allowed to move. In step S5, the control portion 200 stops driving the stepping motor 55, and also, stops the operation of the fixing apparatus 111 by stopping the electric power supply to the exciter coil 30.

Next, referring to FIG. 6, the control carried out by the control portion 200 to make the pressure belt position control mechanism 60 control the pressure belt 13 in position will be described. Referring to FIG. 3A, if one of the edges of the pressure belt 21 moves out of the preset belt movement range because of the shifting of the pressure belt 21 in the direction indicated by the arrow mark F, for example, the belt edge is detected by the pressure belt position sensor 91F, and the pressure belt position sensor 91F outputs a signal Sf3. Further, if the other edge of the pressure belt 21 moves out of the preset belt range, the belt edge is detected by the pressure belt position sensor 91R, and the pressure belt position sensor 91R outputs a signal Sf4. In step S11, if the control portion 200 picks up the output signal Sf3 from the pressure belt position sensor 91F, it moves to step S12, whereas if it picks up the output signals Sf3 and Sf4, it moves to step S15. In step S12, the control portion 200 rotates the stepping motor 65 to rotate the output shaft of the stepping motor 65 in the direction indicated by the arrow mark CW to move the fan-shaped gear 64 downward, that is, the direction indicated by the arrow mark B2 (FIG. 4B) by a preset amount. Thus, the worm gear 66 rotates in response to the rotation of the output shaft of the stepping motor 65, whereby the steering roller support arm 61R is moved, along with the fan-shaped gear 64, in the direction indicated by the arrow mark B2. As the steering roller support arm 61R is rotationally moved in the direction indicated by the arrow mark B2, the pressure belt steering roller 23 is tilted as indicated by the arrow mark B2. As the pressure roller steering roller 23 is tilted as indicated by the arrow mark B2, the pressure belt 21 begins to shift rearward, that is, the direction indicated by an arrow mark R. Then, if the rear edge of the pressure belt 21 moves beyond the preset range for the pressure belt 21, the rear edge is detected by the pressure belt position sensor 91R, and the pressure belt position sensor 91R outputs a signal Sr3. Further, if the front rear edge of the pressure belt 21 moves beyond the preset range for the front edge, the front edge detected by the pressure belt position sensor 91F, and the pressure belt position sensor 91F output a signal Sr4. In step S13, if the control portion 200 picks up the output signal Sr3 from the pressure belt position sensor 91R, it moves to step S14, whereas if it picks up the output signals Sr3 and Sr4, it moves to step S15. In step S14, the 200 rotates the stepping motor 65 in response to the output signal Sr3, to rotate the output shaft of the stepping motor 65 in the direction indicated by an arrow mark CCW to move the fan-shaped gear 64 upward, that is, the direction indicated by the arrow mark B1 (FIG. 4B) by a preset amount. With this rotation of the output shaft of the stepping motor 65, the worm gear 66 rotates, causing the steering roller support arm 61R to rotationally move as indicated by the arrow mark B1. By this rotational movement of the steering roller support arm 61R in the direction indicated by the arrow mark B1, the pressure roller steering roller 23 is tilted as indicated by the arrow mark B1. As the pressure roller steering roller 23 is tilted as indicated by arrow mark B1, the pressure belt 21 begins to shift frontward, that is, in the direction indicated by the arrow mark F. If the front edge of the pressure belt 21 moves beyond the preset range while the pressure belt 21 is moving frontward, the front edge is detected by the pressure belt position sensor 91F, and the pressure belt position sensor 91F output the signal Sf3. Further, if the rear edge moves beyond the preset range, the pressure belt position sensor 91R detects the rear edge, and outputs the signal Sf4. In step S11, if the control portion 200 takes in the output signal Sf3 from the pressure belt position sensor 91R, it moves to step S12, whereas if it takes in both the output signals Sf3 and Sf4, it moves to step S15, and repeats the above described processes in steps S12-S14. Thus, the pressure belt 21 continues to alternately shift frontward and rearward (to snake) within preset pressure belt movement range. In step S15, the control portion 200 stops driving the stepping motor 65, and also, stops the operation of the fixing apparatus 111 by stopping the electric power supply to the inductive heating coil 30.

Figure 7:
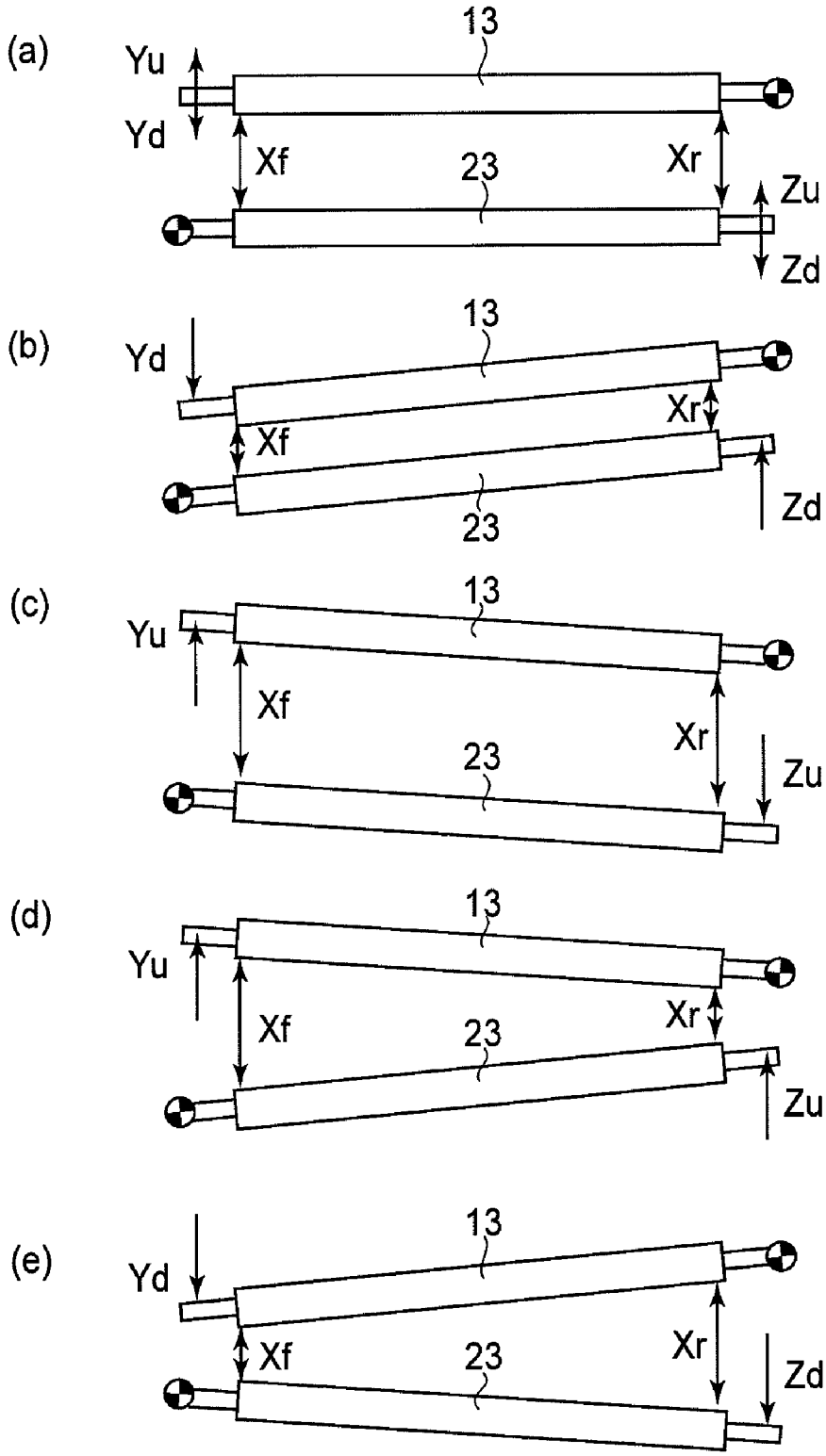
FIGS. 7(*a*)-7(*e*) are schematic drawings which depict the belt steering movement of the fixation belt steering roller and the pressure belt steering roller of the fixing apparatus in the first embodiment.

Referring to FIG. 7, the distance between the fixation belt 11 and pressure belt 21, on the sheet entrance side of the fixing apparatus is as follows. FIG. 7(*a*) is a schematic drawing which shows the positional and attitudinal relationship between the fixation belt 11 and pressure belt 21 of the fixing apparatus 111 in the first embodiment of the present invention before the starting of the steering of the fixation belt 11 and pressure belt 21. FIG. 7(*b*) is a schematic drawing which shows the positional and attitudinal relationship between the fixation belt 11 and pressure belt 21 of the fixing apparatus 111 after the fixation belt steering roller 13 was tilted so that its front end was moved downward, and the pressure belt steering roller 23 was tilted so that its rear end was moved upward. FIG. 7(*c*) is a schematic drawing which shows the positional and attitudinal relationship between the fixation belt 11 and pressure belt 21 of the fixing apparatus 111 after the fixation belt steering roller 13 was tilted so that its front end was moved upward, and the pressure belt steering roller 23 was tilted so that its rear end was moved downward. FIG. 7(*d*) is a schematic drawing which shows the positional and attitudinal relationship between the fixation belt 11 and pressure belt 21 of the fixing apparatus 111 after the fixation belt steering roller 13 was tilted so that its front end was moved upward, and the pressure belt steering roller 23 was tilted so that its rear end was moved upward. FIG. 7(*e*) is a schematic drawing which shows the positional and attitudinal relationship between the fixation belt 11 and pressure belt 21 of the fixing apparatus 111 after the fixation belt steering roller 13 was tilted so that its front end was moved downward, and the pressure belt steering roller 23 was tilted so that its rear end was moved downward.

Referring to FIG. 7(*a*), Xf stands for the distance between the front end of the fixation belt steering roller 13 and front end of the pressure roller steering roller 23, and Xr stands for the distance between the rear end of the fixation belt steering roller 13 and rear end of the pressure roller steering roller 23. Yu stands for the distance the front end of the fixation belt steering roller 13 moves upward as the steering roller supporting arm 51F is rotationally moved, and Yd stands for the distance the front end of the fixation belt steering roller 13 moves downward as the steering roller supporting arm 51F is rotationally moved. Further, Zu stands for the distance the rear end of the pressure roller steering roller 23 moves upward as the steering roller support arm 61R is rotationally moved, and Zd stands for the distance the rear end of the pressure roller steering roller 23 moves downward as the steering roller support arm 61R is rotationally moved.

When the fixation belt steering roller 13 and pressure roller steering roller 23 are in the state shown in FIG. 7(*b*), $$Xf=Xf-Yd, \text{ and } Xr=Xr-Zu.$$

When the fixation belt steering roller 13 and pressure roller steering roller 23 are in the state shown in FIG. 7(*c*), $$Xf=Xf+Yu, \text{ and } Xr=Xr+Zd.$$

When the fixation belt steering roller 13 and pressure roller steering roller 23 are in the state shown in FIG. 7(*d*), $$Xf=Xf+Yu, \text{ and } Xr=Xr-Zu$$

When the fixation belt steering roller 13 and pressure roller steering roller 23 are in the state shown in FIG. 7(*e*), $$Xf=Xf-Yd, \text{ and } Xr=Xr+Zd.$$

Substituting actual values for the terms in the formulas given above, for example, if Xf=Xr=20 mm, and Yu=Yd=Zd=Zu=5 mm.

When the fixation belt steering roller 13 and pressure roller steering roller 23 are in the state shown in FIG. 7(*b*), $Xf$=15 mm, and $Xr$=15 mm.

When the fixation belt steering roller 13 and pressure roller steering roller 23 are in the state shown in FIG. 7(*c*), $Xf$=25 mm, and $Xr$=25 mm.

When the fixation belt steering roller 13 and pressure roller steering roller 23 are in the state shown in FIG. 7(*d*), $Xf$=25 mm, and $Xr$=15 mm.

When the fixation belt steering roller 13 and pressure roller steering roller 23 are in the state shown in FIG. 7(*e*), $Xf$=15 mm, and $Xr$=25 mm.

In other words, the fixing apparatus 111 in the first embodiment changes by no more than 10 mm in the distance between the front end of its fixation belt 11 and pressure belt 21 on the sheet entrance side.

(5) Description of Comparative Fixing Apparatus

Figure 8:
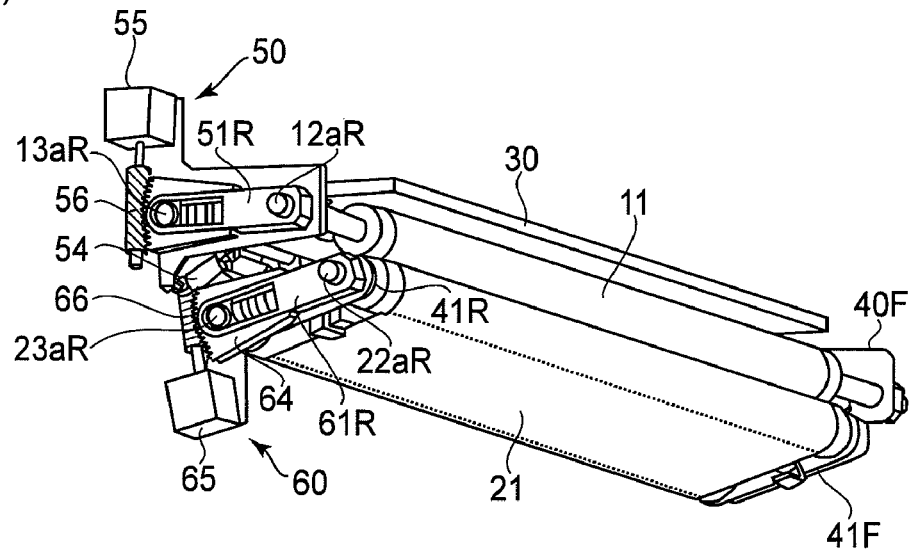
FIG. 8(*a*) is an external perspective view of the fixation belt position controlling mechanism and pressure belt position control mechanism of a comparative fixing apparatus, as seen from the recording sheet entrance side of the apparatus.
Figure 8:
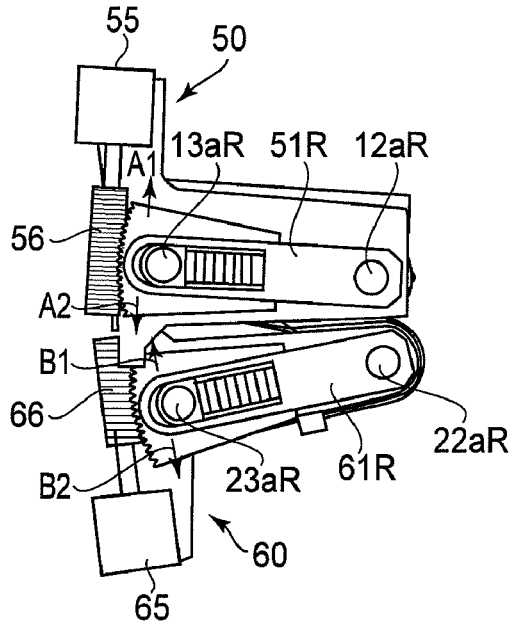
Figure 9:
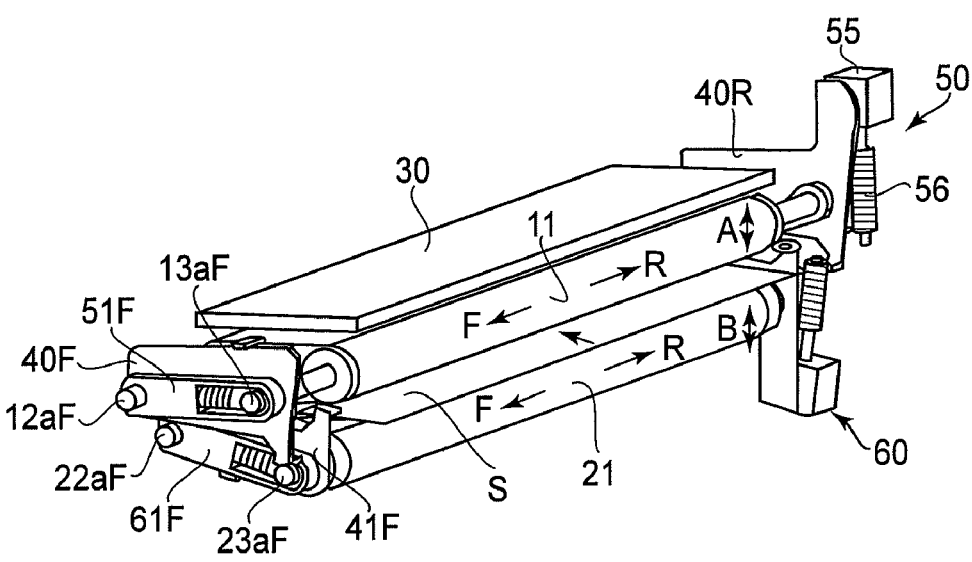
FIG. 9(*a*) is an external perspective view of the fixation belt position control mechanism and pressure belt position control mechanism of the comparative fixing apparatus, as seen from the recording sheet exit side of the apparatus.
Figure 9:
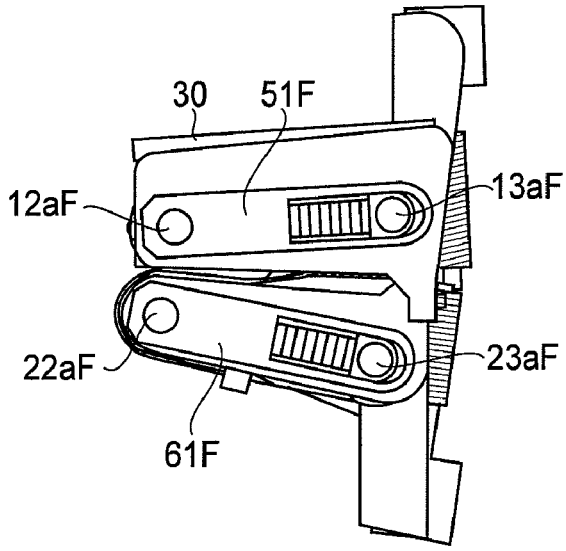

Next, a conventional fixing apparatus as a comparative fixing apparatus to the fixing apparatus 111 in this embodiment will be described about its fixation belt position control mechanism and pressure belt position control mechanism, and their belt position control. FIG. 8(*a*) is an external perspective view of the fixation belt position control mechanism and pressure belt position control mechanism of a typical conventional fixing apparatus as a comparative fixing apparatus, as seen from the recording sheet entrance side of the apparatus. It depicts the structure of the conventional fixing apparatus. FIG. 8(*b*) is a left side (as seen from recording sheet entrance side) view of the fixation belt position control mechanism and pressure belt position control mechanism of the comparative fixing apparatus shown in FIG. 8(*a*). FIG. 9(*a*) is an external perspective view of the fixation belt position control mechanism and pressure belt position control mechanism of the comparative fixing apparatus, as seen from the recording sheet exit side of the apparatus. FIG. 9(*b*) is the left side (as seen from recording sheet entrance side) view of the fixation belt position control mechanism and pressure belt position control mechanism of the comparative fixing apparatus shown in FIG. 9(*a*).

The comparative fixing apparatus is the same in structure as the fixing apparatus 111 in the first embodiment, except for the fixation belt position controlling means 50. The members, portions, etc., of the comparative fixing apparatus, which are the same as the counterparts of the fixing apparatus in the first embodiment are given the same referential codes as those given to the counterparts, one for one, and will not be described here. The lengthwise rear end portion 12*a*R of the metallic core 12*a* of the fixation belt driving roller 12 is rotatably supported by the rear plate 40R and the steering roller support arm 51R of the fixing apparatus 111 (FIGS. 8(*a*) and 8(*b*)). The front end portion 12*a*F of the fixation belt driving roller 12 is rotatably supported by the front plate 40F of the fixation belt position controlling means 50 of the fixing apparatus 111, and the steering roller supporting arm 51F of the fixation belt position controlling means 50 of the fixing apparatus 111 (FIGS. 9(*a*) and 9(*b*)). Of the rear end portion 12*a*R of the metallic core 12*a* of the driving roller 12 and the rear end portion 13*a*R of the metallic core 13*a* of the fixation belt steering roller 13, which are supported by the steering roller support arm 51R of the rear plate 40R, the rear end portion 13*a*R of the metallic core of the fixation belt steering roller 13 is movable upward and downward. Further, the steering roller support arm 51R is rotationally moved upward or downward, respectively, about the axis of the rear end portion of the metallic core 12*a*R of the fixation belt driving roller 12. Thus, as the rear end portion 13*a*R of the metallic core 13*a* of the fixation belt steering roller 13 is moved upward or downward, the fixation belt steering roller 13 is rotationally moved about the center of the front end portion 13*a*F of the metallic core 13*a* supported by the steering roller support arm 51F, in the upward or downward indicated by arrow marks A1 and A2, respectively by a preset amount to steer the fixation belt 11 (FIG. 8(*b*)). That is, the fixation belt position controlling means 50 is structured so that as the steering roller support arm 51R is rotationally moved upward or downward, the fixation belt steering roller 13 is rotationally moved (tilted) by a preset angle about the center of the front portion 13*a*F in such a manner that the rear end portion 13*a*R moves upward or downward as indicated by the arrow marks A1 and A2, respectively. The fixation belt position controlling means 50 is provided with a stepping motor 55, which is on the rear plate 40R, and the worm gear 56 attached to the output shaft of the stepping motor 55 is in mesh with the fan-shaped gear 54 solidly attached to the steering roller support arm 51R. That is, in the case of the comparative fixing apparatus, the steering roller supporting arm 51R attached to the rear plate 40R of the fixation belt position controlling means 50 is enabled to swing upward or downward about the center of the rear portion 12*a*R of the metallic core of the driving roller 12. The principle of the belt position control of the fixation belt position controlling means 50 of the comparative fixing apparatus is the same as that of the belt position control of the fixation belt position controlling means 50 of the fixing apparatus 111. Thus, the belt shift control of the fixation belt position controlling means 50 of the comparative fixing apparatus will not be described here.

Figure 10:
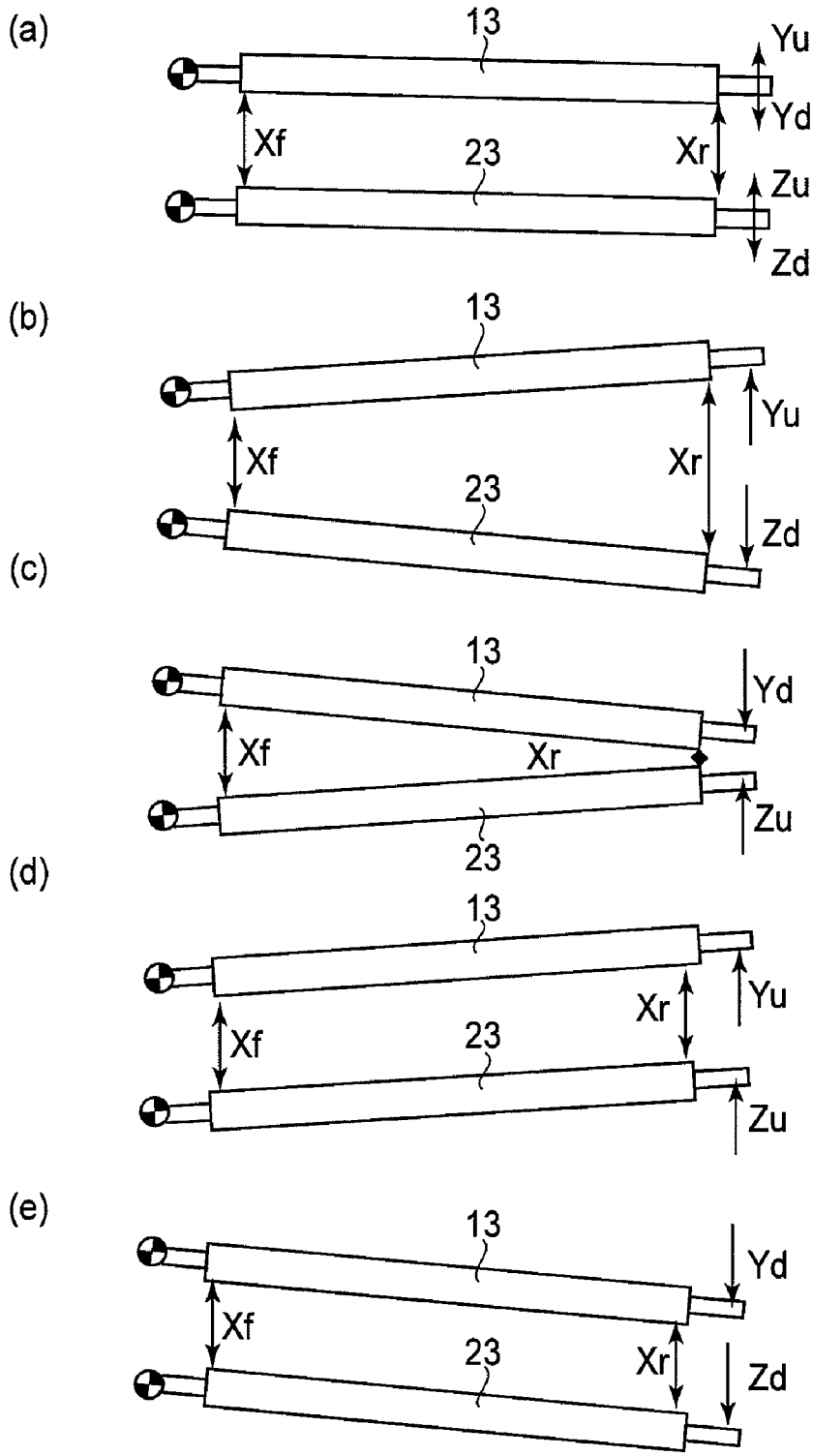
FIGS. 10(*a*)-10(*e*) are schematic drawings which depict the belt steering movement of the fixation belt steering roller and pressure belt steering roller of the comparative fixing apparatus.

Referring to FIG. 10, on the sheet entrance side of the comparative fixing apparatus, the distance between the fixation belt steering roller 13 and pressure roller steering roller 23 changes as follows. FIG. 10(*a*) is a schematic drawing which shows the positional and attitudinal relationship between the fixation belt steering roller 13 and pressure roller steering roller 23 of the comparative fixing apparatus before the starting of the belt steering operation by the fixation belt steering roller 13 and pressure roller steering roller 23. FIG. 10(*b*) is a schematic drawing which shows the positional and attitudinal relationship between the fixation belt steering roller 13 and pressure roller steering roller 23 after the fixation belt steering roller 13 was tilted so that its rear end was moved upward, and the pressure belt steering roller 23 was tilted so that its rear end was moved downward. FIG. 10(*c*) is a schematic drawing which shows the positional and attitudinal relationship between the fixation belt steering roller 13 and pressure roller steering roller 23 after the fixation belt steering roller 13 was tilted so that its rear end was moved downward, and the pressure belt steering roller 23 was tilted so that its rear end was moved upward. FIG. 10(*d*) is a schematic drawing which shows the positional and attitudinal relationship between the fixation belt steering roller 13 and pressure roller steering roller 23 after the fixation belt steering roller 13 was tilted so that its rear end was moved upward, and the pressure belt steering roller 23 was tilted so that its rear end was moved upward. FIG. 10(*e*) is a schematic drawing which shows the positional and attitudinal relationship between the fixation belt steering roller 13 and pressure roller steering roller 23 after the fixation belt steering roller 13 was tilted so that its rear end was moved downward, and the pressure belt steering roller 23 was tilted so that its rear end was moved downward.

Referring to FIG. 10(*a*), Xf stands for the distance between the front end of the fixation belt steering roller 13 and front end of the pressure roller steering roller 23, and Xr stands for the distance between the rear end of the fixation belt steering roller 13 and rear end of the pressure roller steering roller 23. Yu stands for the distance the rear end of the fixation belt steering roller 13 moves (upward) as the steering roller supporting arm 51F is rotationally moved, and Yd stands for the distance the rear end of the fixation roller 13 moves (downward) as the steering roller supporting arm 51R is rotationally moved. Further, Zu stands for the distance the rear end of the pressure roller steering roller 23 moves (upward) as the steering roller support arm 61R is rotationally moved, and Zd stands for the distance the rear end of the pressure roller steering roller 23 moves (downward) as the steering roller support arm 61R is rotationally moved. When the fixation belt steering roller 13 and pressure roller steering roller 23 are in the state shown in FIGS. 10(*b*) and 10(*c*), Xf does not change in value. When the fixation belt steering roller 13 and pressure roller steering roller 23 are in the state shown in FIG. 10(*b*), Xr=Xf+Yu+Zd. When the fixation belt steering roller 13 and pressure roller steering roller 23 are in the state shown in FIG. 10(*c*), Xr=Xf−Yu−Zd. Substituting actual values for the terms in these equations, for example, Xf=Xr=20 mm, and Yu=Yd=Zu=Zd=5 mm.

When the fixation belt steering roller 13 and pressure roller steering roller 23 are in the state shown in FIG. 10(*b*), Xr=30 mm.

When the fixation belt steering roller 13 and pressure roller steering roller 23 are in the state shown in FIG. 10(*c*), Xr=10 mm.

In other words, in the case of the comparative fixing apparatus, the distance between the fixation belt 11 and pressure belt 21 changes no less than 20 mm on the sheet entrance side. The changes in the distance between the fixation belt 11 and pressure belt 21 on the sheet entrance side makes the sheet S change in attitude and behavior when the sheet S is introduced into, and conveyed through, the fixing apparatus. Even if the fixing apparatus is enabled to tolerate the behavioral instability of the sheet S, problems sometimes occur when recording medium (sheet S) which is small in basis weight is used for a two-sided printing operation. More specifically, a sheet of recording medium, which is small in basis weight, is likely to curl. Thus, it is likely to be curled while it is conveyed through a fixing apparatus. Thus, if it is used as recording medium for a two-sided printing (image forming) operation, it sometimes comes into contact with the surface of the fixation belt 11 when the distance between the fixation belt 11 and fixation belt steering roller 13 reduces. This contact sometimes causes an image forming apparatus to output a print with an unsatisfactory image. Further, even if a sheet of recording medium is small in the amount of the curl which occurred along the leading edge, it may be large enough in the amount of the curl which occurred along the trailing edge for its trailing end to rub against the surface of the fixation belt 11.

Compared with the comparative fixing apparatus, the fixing apparatus 111 in the first embodiment was half in the amount of changes in the distance between the fixation belt 11 and pressure belt 21, on the sheet entrance side. Thus, the sheet S remained more stable in behavior when it was conveyed through the fixing apparatus 111 than when it was conveyed through the comparative fixing apparatus. Thus, the employment of the fixing apparatus 111 in this embodiment by an image forming apparatus can substantially reduce the image forming apparatus in the number of unsatisfactory images.

[Miscellanies]

In the first embodiment of the present invention, an image heating apparatus in accordance with the present invention was used as a fixing apparatus for an image forming apparatus. More specifically, the first and second belts of the belt driving apparatus in accordance with the present invention were used as the fixation belt and pressure belt, respectively, of the fixing apparatus. However, the usage of the first and second belts of the belt driving apparatus in accordance with the present invention does not need to be limited to the fixation belt and pressure belt of an image heating apparatus (fixing apparatus). For example, they may be used as the endless intermediary transfer belt and endless image bearing belt (image bearing member, which comes into contact with endless intermediary transfer belt) of an image forming apparatus.

As described above, the present invention can significantly reduce the amount of change in the distance between the first and second belts of a recording medium conveying apparatus (mechanism), and therefore, it can provide a recording medium conveying apparatus (mechanism) which can more reliably convey recording medium than any of conventional recording medium conveying apparatuses (mechanisms).

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 175202/2009 filed Jul. 28, 2009 which is hereby incorporated by reference.

What is claimed is:

1. A belt driving apparatus comprising:

a first rotatable belt member;

a first supporting member rotatably supporting said first belt member;

a first steering roller, rotatably supporting said first belt member, for adjusting a position, with respect to a widthwise direction perpendicular to a rotational direction, of said first belt member, wherein one end of said first steering roller is fixed, and an other end of said first steering roller is movable;

control means for controlling movement of said other end of said first steering roller;

a second rotatable belt member contacted to said first belt member;

a second supporting member rotatably supporting said second belt member;

a second steering roller, rotatably supporting said second belt member, for adjusting a position, with respect to the widthwise direction, of said second belt member, wherein one end of said second steering roller remote from said one end of said first steering roller is fixed, and an other end of said second steering roller adjacent said one end of said first steering roller is movable; and control means for controlling movement of said other end of said second steering roller.

2. An apparatus according to claim 1, wherein said first steering roller and said second steering roller are opposed to each other with said first belt member and said second belt member interposed therebetween.

3. An apparatus according to claim 1, wherein said first steering roller is disposed upstream, with respect to the rotational direction of said first belt member, of a position where said first belt member and said second belt member are contacted to each other.

4. An apparatus according to claim 1, wherein said second steering roller is disposed upstream, with respect to the rotational direction of said second belt member, of a position where said first belt member and said second belt member are contacted to each other.

5. An image forming apparatus for forming an image on a recording material, comprising:

a first rotatable belt member;

a first supporting member rotatably supporting said first belt member;

a first steering roller, rotatably supporting said first belt member, for adjusting a position, with respect to a widthwise direction perpendicular to a rotational direction, of said first belt member, wherein one end of said first steering roller is fixed, and an other end is movable;

control means for controlling movement of said other end of said first steering roller;

a second rotatable belt member contacted to said first belt member to form a nip for nipping and feeding the recording material;

a second supporting member rotatably supporting said second belt member;

a second steering roller, rotatably supporting said second belt member, for adjusting a position, with respect to the widthwise direction, of said second belt member, wherein one end of said second steering roller remote from said one end of said first steering roller is fixed, and an other end of said second steering roller adjacent said one end of said first steering roller is movable; and control means for controlling movement of said other end of said second steering roller.

6. An apparatus according to claim 5, wherein said first steering roller and said second steering roller are opposed to each other with said first belt member and said second belt member interposed therebetween.

7. An apparatus according to claim 5, wherein said first steering roller is disposed upstream, with respect to the rotational direction of said first belt member, of a position where said first belt member and said second belt member are contacted to each other.

8. An apparatus according to claim 5, wherein said second steering roller is disposed upstream, with respect to the rotational direction of said second belt member, of a position where said first belt member and said second belt member are contacted to each other.

9. An apparatus according to claim 5, further comprising heating means for heating said first belt member to heat the image on the recording material.

* * * * *